United States Patent [19]

Spiegelberg

[11] 4,096,076

[45] Jun. 20, 1978

[54] FORGING COMPOUND

[75] Inventor: William D. Spiegelberg, Parma, Ohio

[73] Assignee: TRW Inc., Cleveland, Ohio

[21] Appl. No.: 653,382

[22] Filed: Jan. 29, 1976

[51] Int. Cl.[2] ..... C10M 1/10

[52] U.S. Cl. ..... 252/30; 72/42; 252/28; 252/29

[58] Field of Search ..... 252/28, 29, 30

[56] References Cited

U.S. PATENT DOCUMENTS

| | | | |
|---|---|---|---|
| 3,059,769 | 10/1962 | Frost | 252/28 X |
| 3,254,401 | 6/1966 | Dalton et al. | 252/28 X |
| 3,384,581 | 5/1968 | Peace | 252/28 X |
| 3,411,564 | 11/1968 | Miller | 252/28 X |
| 3,558,488 | 1/1971 | Mann | 252/28 |
| 3,575,858 | 4/1971 | Adair et al. | 252/28 X |
| 3,840,461 | 10/1974 | Espunes | 252/28 X |

FOREIGN PATENT DOCUMENTS

| | | | |
|---|---|---|---|
| 1,285,084 | 7/1965 | Germany | 252/30 |
| 2,430,249 | 6/1974 | Germany | 252/30 |

*Primary Examiner*—Delbert E. Gantz

*Assistant Examiner*—Andrew H. Metz

[57] ABSTRACT

A forging compound particularly adapted for hot die dwell forging of titanium and its alloys comprises boundary layer particles (boron nitride or graphite) and a major quantity (more than 60% by weight) of vitreous components. The vitreous components comprise diboron trioxide and silica frit containing a metal oxide wetting agent. In a preferred form, the forging lubricant comprises about 14 to 25% by weight boron nitride particles, balance, vitreous components. The latter comprise about 60% to 75% by weight diboron trioxide, balance silica glass containing cobalt oxide wetting agent in an amount of 1.0 to 3% by weight of the vitreous components. All the foregoing ingredients may be dispersed in a coatable carrier preferably comprising a solvent, e.g., xylene, in which a resin binder is dissolved. A method of using the lubricant includes coating workpieces with the lubricant, heating the workpieces to forging temperature, and imposing forging pressure on the workpiece within an enclosed die for a dwell period to creep-flow the workpiece metal into conformity with the forging die.

10 Claims, No Drawings

FORGING COMPOUND

BACKGROUND OF THE INVENTION

The invention herein described was made in the course of or under a contract, or subcontract thereunder, with the U.S. Air Force.

The present invention is concerned with an improved forging compound, more particularly with a compound which serves as a forging lubricant, parting compound and protective coating particularly suited for use in hot die dwell forging of titanium and titanium alloys, and to a forging method using such compound. (The compound may be sometimes hereinafter referred to as a "lubricant" although it serves other functions as indicated above.)

The forging of metal workpieces involves shaping metal by controlled plastic deformation under impact or pressure, usually while the workpiece is positioned within a suitably shaped die. The workpiece may be either a blocker of simple shape, such as a flat bar, or may be a preform which has been given a preliminary shape by forging or other means. A substantial amount of plastic flow of the metal is required to produce faithfully all the details of the die on the forged article made from the workpiece. It is common practice to employ a lubricant on the workpiece or on the die or on both in order to facilitate the metal flow into the different portions of the die.

Forging operations are usually carried out with the workpiece having been pre-heated to a high temperature to facilitate the flow of the metal during the forging step. The forging die may also be heated in order to reduce or eliminate the chilling effect which the die has on the heated workpiece. Normally, for forging titanium and its alloys, the workpiece is heated to temperatures between about 1500° to 1800° F. Alpha-beta titanium alloys are usually heated to just below the beta transus temperature, which lies in the mentioned temperature range, in order to produce desirable metallurgical and mechanical properties in the forged article. Particularly for titanium and its alloys, it must be protected from air during such preheating, otherwise severe oxidation will be incurred. In conventional forging practice, the die would be heated only to a temperature of about 300° to 800° F. However, this results in considerable die chilling of the workpiece, which may cause cracks and other surface defects in the forged article.

Conventional forging practice also calls for sharp, high impact blows on the workpiece to conform it to the shape of the die. This results in high stresses and excessive wear on the die surface. An effective alternative method is dwell forging, in which a high pressure is imposed on the workpiece for a dwell period of, e.g., at least about five seconds, usually considerably longer, in order to creep-flow the metal.

A particularly effective method of forging, particularly of forging titanium and titanium alloys, in hot die isothermal dwell forging (sometimes hereinafter referred to as HDD forging). In HDD forging, both the die, which is usually made of a nickel base "superalloy", and the metal workpiece are heated to substantially the same temperatures (usually between 1500° to 1800° F) so that the chilling effect of the die on the workpiece is substantially eliminated. Instead of high impact blows, dwell forging as described above is used to impose a "creep" plastic deformation on the workpiece to flow the metal into conformity with the die surfaces. As in conventional forging, a lubricant is utilized in HDD forging to facilitate the metal flow into conformity with the die surfaces.

To perform effectively in HDD forging, a forging compound must satisfy a number of severe and sometimes conflicting demands. Despite the high temperature of the die and workpiece, and prolonged preheat and high pressure dwell times, the forging compound:

(1) Must adhere uniformly to the entire workpiece and protect it from oxidation during the prolonged preheat period (particularly important in the case of titanium and its alloys);

(2) Must not itself oxidize, crystallize, or otherwise decompose during the preheat or forging phases;

(3) Must not chemically attack either the workpiece or the die;

(4) Must provide effective forging lubrication which means that it must have both sufficient lubricity and proper viscosity to maintain a lubricant film between workpiece and die during all stages of deformation of the metal;

(5) Must prevent galling and bonding between the die and the forged article and permit easy release of the forged article from the die, without causing adhesion or forming glassy "stringers" causing difficult release or part distortion on removal; and (6) Must not accumulate in the die, even in the crevices and recesses of complex enclosed dies, to avoid loss of forging details due to metal blockage by accumulated compound.

It is the objective of the present invention to provide a forging compound which satisfactorily meets the foregoing criteria, and a method of using the same. More particularly, it is an objective of the present invention to provide a forging compound particularly suited for HDD forging and a method of HDD forging using the compound, and to provide such a compound and method for forging titanium and its alloys. Other objectives and advantages will be apparent from this description.

It will be appreciated that the characteristics which make a forging compound able to meet the rigorous demands of HDD forging provides a compound which would be useful in other types of forging and metal working applications.

A large number of metal working lubricants, and specifically forging lubricants are known. Among these are: particulate boundary layer lubricants such as glass, ceramic, graphite, talc, boron nitride, and molybdenum disulfide; and organic lubricants such as greases, oils, etc. Various admixtures of one or more of the foregoing are also known, as is the utilization of liquid vehicles (water, hydrocarbon or other organic liquids, etc.) as a carrier for the solid particulate lubricants, and binders to agglomerate them. Use of lubricants such as glass or ceramic which melt to a flowable consistency so as to provide hydrodynamic lubrication at the use temperature is also known.

U.S. Pat. No. 3,059,769, for example, shows a solid lubricant disc with a central hole for extrusion operations which, in one embodiment, comprises glass with up to about 40% boron nitride, held together by a suitable binder. A heated steel or titanium rod is extruded through the disc, part of which melts to a suitable viscosity to provide lubricant action. The insufficiently viscous portions are expelled by the extrusion action through the open ended extrusion die. It will be appreciated that in forging operations, the lubricant is trapped within the die by the metal being forged and, as explained in more detail below, a successful forging lubricant must provide features including closely controlled viscosity to follow the metal flow, lack of accumulation within the die, and separability of the forged part from the die.

In accordance with the present invention there is provided a forging compound which is particularly adapted for hot die isothermal dwell forging, and comprises essentially a minor portion (less than 40% by weight) of boundary layer lubricant particles which remain solid at the forging temperature and a major portion (over 60% by weight) of a vitreous component particles which are fusible at or below the forging temperature. By "fusible" is meant that the vitreous components soften at least sufficiently to provide a hydrodynamic action which aids in providing lubricity. The boundary layer particles are preferably boron nitride particles, although graphite particles may be used under certain conditions. Mixtures of boron nitride and graphite are also contemplated. The vitreous phase is a borosilicate glass containing a metal oxide wetting agent.

The boundary layer particles comprise less than 40% by weight preferably between about 14 to 25% by weight, of the total of boundary layer particles and vitreous components. The boundary layer particles are available commercially in two sizes, −40 mesh, and −325 mesh. The particle size should be smaller than −40 mesh, i.e., smaller than 95% of the particles passing through a size 40 mesh. Preferably, the boundary layer particles are of a size that at least 95% of the particles pass through a size 325 mesh.

The vitreous phase preferably comprises diboron trioxide in the amount of about 60 to 75% by weight (of the vitreous phase), balance silica glass and metal oxide wetting agent. The wetting agent is one or more of the oxides of cobalt, barium, and manganese, present in the total amount of between one-half to 5%, preferably between 1 to 3%, by weight of the vitreous components. Cobalt oxide is the preferred metal oxide. Extensive tests show that cobalt oxide works well, and theoretical considerations indicate that oxides of barium and manganese should also work, without unduly affecting the vitreous phase properties as other metal oxides do.

To avoid corrosive attacks by the glass phase, oxides of elements such as lithium, sodium, potassium, vanadium, and phosphorous should not be present in amounts greater than 500 parts per million (ppm) of the vitreous components. Sulfur should be less than 100 ppm to avoid corroding the hot dies. Other oxides commonly found in glass, such as oxides of calcium, magnesium, lead, cerium, etc. should also not be present in significant quantities to avoid any tendency to cause the borosilicate glass of the invention to crystallize, particularly during a prolonged preheat. Lead, of course, tends to react with titanium and to attack nickel, which makes it undersirable from that point of view also.

The ratio range of diboron trioxide to silica is also important in maintaining proper viscosity of the glass, neither too "thin" to cling to the workpiece and so act as an effective lubricant, nor too "stiff" to follow the metal flow. Increasing amounts of boron tends to lower the viscosity, increasing amounts of silica tends to increase it.

The boundary layer lubricant particles and the vitreous phase particles are preferably dispersed in a coatable carrier to facilitate application and pre-use adherence of the lubricant on workpieces. The carrier is preferably an organic liquid solvent such as xylene in which a resin binder has been dissolved. (All references to percents by weight, unless specifically otherwise noted, exclude the carrier components and are based solely on the content of boundary layer particles and vitreous components.)

A method of hot die isothermal dwell (HDD) forging includes precoating the metal workpieces with the forging compound of the invention by brushing, spraying, dipping or other suitable means, heating a forging die and the coated workpieces to a temperature, e.g. to about 1500° to 1800° F, and forging the heated workpieces in the heated die by imposing forging pressure on the workpieces for a dwell period of at least five seconds to creep-flow the metal into conformity with the die. Preferably, the workpiece is titanium or a titanium alloy and the die is made of a nickel base alloy or refractory metal alloy. For example, the die material may be a molybdenum base alloy such as TZM moly, which is used in a vacuum environment to preclude oxidation. The coated workpieces may be dried at a lower temperature before the preheating. Preheating may be carried out in preheat furnaces, in the enclosed die, or in both.

Minor quantities and trace elements in the compound of other constituents such as aluminum and silicon normally found in the ingredients employed, are contemplated.

When the forging lubricant mixture is heated to the preheat or forging temperature (e.g., 1500° to 1800° F) the diboron trioxide melts at a relatively low temperature (about 600° F) and forms a glass which dissolves the silica frit, the solubility of the silica frit in the fused diboron trioxide glass increasing with increasing temperatures. The resultant borosilicate glass has a viscosity determined by the silicon to boron ratio of the composition, is inert and stable and will disperse and protect the boron nitride (or graphite) particles which are refractory and do not melt even at the highest metal forging temperatures. The vitreous phase melts sufficiently to provide a moderately low shear strength film capable of flowing and thinning as deformation of the workpiece proceeds in the forging operation. At the same time, the fused vitreous phase coats and carries the solid boron nitride (or graphite) particles so as to disperse the particles uniformly over the workpiece surface and maintain them so dispersed as deformation of the metal proceeds.

To test the stability of the forging lubricant of the invention vertical rods were coated with the lubricant and heated for 4 hours at 1750° F. Visual observation showed no devitrification (crystallization) and no coating breakdown caused by flow of the glass adhered to the heated rod. A similar test with a borosilicate glass containing a substantial proportion of lead oxide showed visual evidence of coating breakdown after 1 hour at 1750° F.

Tests of weight loss of the forging lubricant of the invention caused by oxidation were carried out in which the lubricant was applied to a test tab of titanium alloy and heated at 1300° F for a period of 8 hours. (Attempts to test oxidation weight losses at 1700° F were unsuccessful due to the fact that oxidation of the exposed titanium occurred which more than offset weight losses due to coating oxidation). Acceptable lubricant weight losses were noted. Formulation of the invention which utilize graphite particles instead of boron nitride particles as the boundary layer component, showed that such graphite-filled lubricants could not be held for more than 2 hours at the 1300° F oxidation test without undergoing excessive amounts of breakdown due to oxidation. However, the graphite forging compound of the invention can successfully be employed at temperatures of 1300° F and higher, e.g., 1500° to 1800° F, in the environment of an enclosed forging die, since the compound is protected from exposure to air while in the die. As used herein, an "enclosed" die is one in which the workpiece is enclosed on all sides by the die and punch: the term "enclosed" die is intended to also include those die configurations, of a type known in the art, in which openings or passages are left through which flash is extruded, although the workpiece is substantially enclosed and protected by the die on all sides.

Graphite will perform satisfactorily as the boundary layer component of the forging component, although lubricity of the graphite-based formulation is not as great as that of the boron nitride formulation. However, the major drawback is graphite's susceptibility to oxidation. This may be overcome by (a) limiting the preheat time and temperature, e.g., to a period of less than 2 hours at a temperature of not more than 1300° F, and completing the preheat in the enclosed die, or (b) otherwise protecting the forging compound from oxidation by carrying out the preheat at higher temperature and longer periods, e.g., up to 1800° F and four hours or more, in a protective or reducing atmosphere.

Preferably, the forging compound of the invention can withstand without degradation preheat temperatures of 1500°-1800° F for at least four hours in the normal atmosphere provided by either gas-fired or electric-fired preheat ovens. Boron nitride formulations of the invention meet this criterion; graphite formulations do not. The graphite formulations can, however, withstand without degradation or special protection about ½ hour under such conditions.

Chemical compatibility of the forging lubricant of the invention was tested by applying the forging lubricant (together with other forging lubricant formulations for comparison and control) to the upper surfaces of small (approximately ½ inch diameter by ½ inch tall) cylindrical specimens of various nickel base die materials including In-100 (manufactured by International Nickel Co.) and UDIMET 700 (manufactured by Special Metals Corporation, whose registered trademark UDIMET is). Both In-100 and UDIMET 700 are nickel base alloys containing, respectively, about 60.5% and 53.4% by weight nickel, plus substantial amounts of chromium and cobalt, together with lesser amounts of molybdenum, titanium, and aluminum and minor amounts of boron, carbon and other additives. Coated samples together with uncoated control samples were heated in an electric furnace in still air at 1700° F. A series of exposures, each 16 hours long, was employed to simulate the environment of the forging operation. The forging lubricant of the invention was entirely satisfactory showing no adverse effects on the die material, although some of the other lubricants showed significant corrosion. Thus, the lubricant of the invention is compatible with nickel base die alloys.

The following are some specific examples of forging lubricants in accordance with the invention.

EXAMPLE I

| % By Weight | Component |
|---|---|
| 14 to 25 | Boron nitride or graphite |
| 74 to 85 | Borosilicate glass or its components |
| 1 to 3 | *Metal oxide |

*Metal oxide may be an oxide of cobalt, manganese or barium thereof, but preferably is cobalt oxide.

EXAMPLE II

| % By Weight | Component |
|---|---|
| 25 | Boron nitride |
| 75 | *Vitreous phase components |

EXAMPLE III

| % By Weight | Component |
|---|---|
| 14 | Boron nitride |
| 86 | *Vitreous phase components |

*Vitreous phase components for both Examples II and III are as follows:

| % By Weight | Component |
|---|---|
| 67 | Diboron trioxide |
| 31 | Silica glass frit |
| 2 | Cobalt oxide |

EXAMPLE IV

Any of Examples I, II or III, dispersed in a coatable carrier comprising an organic liquid (e.g., toluene, benzene or xylene) in which a resin binder is dissolved.

EXAMPLE V

Particulate material in the proportions of Example II above comprise 125 grams of boron nitride and 375 grams of vitreous phase components. These are mixed in a liquid vehicle comprising 960 cubic centimeters of xylene in which 218 grams of an acrylic emulsion resin binder is dissolved. The boron nitride has a particle size which permits at least about 95% of the particles to pass through a 325 mesh screen. The vitreous phase includes finely ground silica frit and diboron trioxide in addition to cobalt oxide. The particulate material is added to the liquid phase with constant stirring to provide a uniformly dispersed particulate phase in the liquid vehicle. A total of 1.58 kilograms of forging lubricant is thus provided.

EXAMPLE VI

Particulate material in the proportions of Example III above comprise 94 grams of boron nitride having the same particle size as thos of Example V, and 571 grams of vitreous phase components in the form of a finely ground silica glass frit containing finely ground diboron trioxide and cobalt oxide. The particulate material is slowly added with stirring to a liquid vehicle comprising 1200 cubic centimeters of xylene in which are dissolved 325 grams of an acrylic resin organic binder. The particulate material is dispersed throughout the liquid vehicle. A total of 2.07 kilograms of forging lubricant is thus provided.

In HDD forging processes, as in other forging processes, the workpieces to be forged are heated prior to the forging step to bring them up to the forging temperature. In HDD forging of titanium and titanium alloys such as, for example, Ti-6 Al-4V alloy, the workpieces are preheated to a temperature of 1500° to 1800° F, preferably to just below 1600° F. This preheating is carried out in a preheating furnace in which the workpieces are heated for prolonged periods of at least about ¼ hour, and which may range up to 4 hours, or longer. A solvent-free, uniform coating of solid particulate lubricant bound to the workpiece results. Since it is obviously convenient to coat the workpieces with lubricant prior to preheating the same, rather than to have to apply the lubricant to a preheated workpiece, it is desirable that the forging lubricant be able to withstand the prolonged periods of preheating and attendant handling without interruption of the continuity of the lubricant surface over the workpieces, devitrification (crystallization) of the vitreous phase components, or oxidation of the boron nitride (or graphite) material.

The borosilicate glass formed by melting of the vitreous phase of the lubricant of the invention has a viscosity which is controllable by altering the ratio of silicon to boron in the glass to meet any specific forging operation requirements. The borosilicate glass may be present as particles of borosilicate glass per se, or the forging lubricant may be formulated by adding thereto precursor components (e.g. diboron trioxide and silica glass frit) which fuse in the forging environment to form the borosilicate glass.

Whereas the particle size of the vitreous phase particles need only be small enough to promote dispersion within the liquid carrier and to facilitate melting or fusing of the particles rapidly at or below the forging temperature, the boron nitride or graphite particles are preferably very fine to ensure coating of the solid particles by the fused vitreous phase and mobility of the particles with the vitreous phase. The average particle size of the boron nitride or graphite is preferably such that at least 95% of the particles pass a 325 mesh screen.

The liquid vehicle is preferably an aromatic organic liquid solvent such as benzene, toluene, xylene or the like. Xylene is preferred because, although relatively slow to evaporate, it has proven to work satisfactorily with most organic resin binders and has a reasonably high flash point (82° F). This flash point is high enough to permit shipment by common carrier provided packaging and marking requirements meet applicable federal regulations. Another advantage of xylene is that unlike oxygenated organic compounds such as some alcohols or acetones, it is chemically inert to diboron trioxide. However, oxygenated organic solvents can be used if the diboron trioxide and silica are prereacted to form the borosilicate glass. Isopropyl alcohol and ethanol are satisfactory, as are chlorinated hydrocarbons, (e.g., trichloroethane), mineral spirits, petroleum distillates, etc.

A resin binder is dissolved in the solvent to give a hard, nontacking quality to the coating when it is applied to the workpieces (or the dies). The binder helps to ensure that the lubricant applied to the cold or preheated workpieces sets to a hard, nontacky finish which minimizes the danger of lubricant being smudged off areas of the workpiece during handling of the same prior to the forging operation. An acrylic emulsion has been found satisfactory as the resin binder and compatible with xylene. Other suitable binders are methyl cellulose, polycarbonate, polyurethane, and epoxies. Instead of using solvent liquids, it is conceivable that the compound be applied by heating it in admixture with resin particles such as in fluidized beds in which the workpieces are placed, or by electrostatic or other dry applicatory techniques.

The silica glass frit contains one or more metal oxides, in amounts comprising ½ to 5%, preferably 1 to 3% by weight of the total weight of the vitreous components. The metal oxides serve primarily as a wetting agent to cause the compound to adhere to the metal even under the high forging pressure, and also serves to increase stability of the forging compound, particularly during long term exposure at preheating temperatures of the die prior to forging. In addition, cobalt oxide particularly tends to darken the color of the forging lubricant coating and render it opaque, which has the added benefit of providing reduced radiation losses from the workpieces during the time the preheated, lubricant-coated pieces are transferred from the preheat oven to the forging die. Enough metal oxide must be added to provide the wetting ability; too much, however, tends to cause the glass to crystallize which renders it ineffective.

It has been found that the hydrodynamic lubrication provided by the fused vitreous phase gives better lubricity than the boron nitirde or graphite particles and thus facilitates metal flow. However, the fused vitreous phase if used by itself tends to cause accumulation of lubricant in the nickel base alloy dies, and part ejection difficulties, as well as having an adverse affect on surface finish of titanium and titanium alloy parts. At the cost of a decrease in lubricity, the foregoing disadvantages are offset by adding boron nitride or graphite particles of proper fine size to the lubricant. It has been found that at least for HDD forging of titanium and its alloys, the boron nitride or graphite particle content should be not less than about 14% by weight to ensure satisfactory surface finish and no significant accumulation in the die, and not more than 25%, to ensure sufficient lubricity.

Prior to mixing, the boron nitride particles are advantageously kept sealed in inert atmosphere storage containers so as to avoid agglomeration of the particles as may occur upon exposure to air, particularly in the pressure of diboron trioxide. The solvent liquid, if employed, protects the diboron trioxide in storage of the compound. Pre-reaction to lower borosilicate glass also provides such protection.

The forging compound of the invention may be applied to workpieces, for example titanium or titanium alloy workpieces in any suitable manner by brushing, dipping, spraying, etc. Lubricants have been successfully applied to workpieces with a siphoning type air atomizing spray gun. A venturi type nozzle orifice may be utilized to spread the lubricant into a fan shaped spray for application to the workpieces.

EXAMPLE VII

Ti-6Al-4V forging blanks were sprayed with a lubricant in accordance with Example V and VI, and the sprayed-on lubricant dried in a recirculating air oven at 180° F to a hard, non-tacky finish. The lubricant coated pieces were then preheated for 15 minutes at 1250° F in an electric furnace. Final preheating for an additional 10 minutes was carried out under a light load between heated nickel base alloy forging dies at 1600° F. (This type of preheating is expecially suited to the graphite embodiment of the invention). The lubricant coated forgings were then pressed for a total dwell time of 6 minutes under a forging load of 150 tons (10 tons per square inch).

The forging stock was an annealed Ti-6Al-4V alloy plate meeting the requirements of AMS 4811B, and additionally specified that the material structure should consist of equiaxed or moderately elongated alpha phase in a matrix of transformed beta, indicative of finishing operations carried out below the beta transus. The flat plate stock was forged into a piece of generally I-beam cross-section having 2 transverse ribs extending from flange to flange on one side of the web, and of the same depth as the flange. In addition, a boss was formed in the web. At various locations around the piece rib thicknesses were varied from about 0.090 inches, which cannot easily be filled to the full rib height without overstressing the dies, to about 0.180 inches, which fills easily but severely tests the capability to fill a thin rib adjacent to a thick one. The boss is of low profile and easily filled but was added to allow a measure of lubricant residue buildup. Faithful reproduction of a sharp radius provided at the upper surface of the cross rib as well as the amount of residual material on the punch associated with this feature also provided a measure of lubricant accumulation tendency.

The forging lubricants tested provided good quality forgings with the difficult test piece of Example VII. A good rate of metal deformation was obtained and no significant accumulation of lubricant within the dies was sustained despite repeated forgings, sometimes in sequences as high as ninety forgings without cleaning of the die. This is to be contrasted with commercial practice using fused glass lubricants wherein die cleaning after each forging is sometimes required. Good surface finish of the forged pieces was observed.

Test of a similar nature with a forging lubricant otherwise identical but containing only 7% by weight of the boron nitride provided similar results except that the surface finish of the forged pieces was unsatisfactory due to the reduced boron nitride content, and lubricant accumulated in the dies at a greater rate.

While the invention has been described in detail with respect to specific formulations thereof, it will be appreciated that variations and alterntions of the formulation may be made within the broad parameters disclosed. It is intended to include all such alterations and modifications within the scope of the appended claims.

What is claimed is:

1. A forging compound for at least partially coating workpieces of titanium and its alloys prior to hot die forging of the workpiece, said forging compound comprising a mixture of boundary layer particles and a powder of vitreous components, said boundary layer particles remaining solid at forging temperatures and being selected from boron nitride, graphite and mixtures thereof, said boundary layer particles being less than 40% and more than 7% by weight of the total vitreous and boundary layer components of the forging compound, said powder of vitreous components being substantially free of materials which have a tendency to corrosively attack the forging dies and comprising diboron trioxide in an amount between about 60 to 75% by weight of the vitreous components and silica glass to provide a desired viscosity during forging, the balance of the vitreous components comprising a metal oxide wetting agent to promote spreading of the vitreous components over the surface of the workpiece during forging, the metal oxide wetting agent being between about one-half of 1 to 5% by weight of the vitreous components and being an oxide of cobalt.

2. The compound of claim 1 wherein the boundary layer particles are boron nitride particles and the metal oxide is cobalt oxide.

3. The compound of claim 1 wherein the boundary layer particles are of a size that at least 95% thereof pass through a 325 mesh screen and comprise between about 7 to 25% by weight of the total of boundary layer particles and vitreous components, the diboron trioxide comprises between about 67 to 75% by weight of the vitreous components, and the metal oxide comprises between about 1 to 3% by weight of the vitreous components.

4. The compound of claim 3 wherein the boundary layer particles are boron nitride and the metal oxide is cobalt oxide.

5. The compound of claim 4 having the following composition:

| % By Weight | Component |
|---|---|
| 25 | Boron nitride |
| 75 | Vitreous components |

with the vitreous components comprising

| % By Weight of Vitreous Components | Component |
|---|---|
| 67 | Diboron trioxide |
| 31 | Silica glass frit |
| 2 | Cobalt oxide |

6. The compound of claim 4 having the following composition:

| % By Weight | Component |
|---|---|
| 14 | Boron nitride |
| 86 | Vitreous components |

with the vitreous components comprising

| % By Weight of Vitreous Components | Component |
|---|---|
| 67 | Diboron trioxide |
| 31 | Silica glass frit |
| 2 | Cobalt oxide |

7. The compound of claim 1 wherein the diboron trioxide, silica glass frit, and metal oxide have been reacted in advance of use to form a borosilicate glass containing the metal oxide.

8. A forging compound as set forth in claim 1 wherein said boundary layer particles are of a size less than that at which at least 95% of the particles pass through a 40 mesh screen.

9. A forging compound as set forth in claim 1 wherein said vitreous components are substantially free of oxides of lithium, sodium, potassium, vanadium and phosphorus all of which tend to corrode forging dies.

10. A forging compound as set forth in claim 1 wherein said vitreous components are substantially free of oxides of calcium, magnesium, lead and cerium to retard crystallization of the forging compound during preheating.

* * * * *